US007252215B1

(12) United States Patent
Furnas, II

(10) Patent No.: US 7,252,215 B1
(45) Date of Patent: Aug. 7, 2007

(54) WATCH PROTECTOR FOR PROTECTING A WRIST-WATCH

(76) Inventor: William J. B. Furnas, II, P. O. Box. 22754, Lincoln, NE (US) 68542-2754

( * ) Notice: Subject to any disclaimer, the term of this patent is extended or adjusted under 35 U.S.C. 154(b) by 472 days.

(21) Appl. No.: 10/744,325

(22) Filed: Dec. 23, 2003

Related U.S. Application Data

(60) Provisional application No. 60/446,834, filed on Feb. 12, 2003.

(51) Int. Cl.
*A45C 5/00* (2006.01)

(52) U.S. Cl. ..... 224/170; 224/164

(58) Field of Classification Search ..... 224/170, 224/218, 219, 164, 165, 178; D11/5
See application file for complete search history.

(56) References Cited

U.S. PATENT DOCUMENTS 2,998,695 A * 9/1961 Cornett ..... 368/282
3,547,323 A 12/1970 Sledge, Jr. et al.
4,103,808 A 8/1978 Hallman et al.
4,155,219 A * 5/1979 Anderson ..... 368/282
4,387,838 A * 6/1983 Jackson ..... 224/170
D287,229 S * 12/1986 Hallman et al. ..... D11/5
5,332,135 A 7/1994 Fletcher
D373,900 S * 9/1996 Montgomery, Sr. ..... D3/226
5,671,481 A * 9/1997 Giard ..... 2/170
D390,800 S * 2/1998 Yamamoto ..... D11/3
6,108,876 A 8/2000 Hubbert
6,199,730 B1 * 3/2001 Chisolm ..... 224/164

* cited by examiner

*Primary Examiner*—Tri M. Mai
(74) *Attorney, Agent, or Firm*—Eric Karich

(57) ABSTRACT

A watch protector for protecting a wrist-watch worn around a wrist has a bottom protective panel, a top protective panel, and a watch cover portion. The bottom protective panel is adapted to be positioned around the wrist. The top protective panel fits over the bottom protective panel to surround the watchband of the wrist-watch. The watch cover portion is attached to the top protective panel to protect the watch face.

4 Claims, 2 Drawing Sheets

WATCH PROTECTOR FOR PROTECTING A WRIST-WATCH

CROSS-REFERENCE TO RELATED APPLICATIONS

This application for a utility patent claims the benefit of U.S. Provisional Application No. 60/446,834, filed Feb. 12, 2003.

STATEMENT REGARDING FEDERALLY SPONSORED RESEARCH

Not Applicable

BACKGROUND OF THE INVENTION

Prior art wrist-watch protection devices are primarily made up of special wristbands that are adapted to be attached to a watch face once the watch face has been removed from its original watchband. The wristband include a pair of attachment points for attaching the watch face to the wristband; and the wristband further includes a protective cover portion that fits over and protects the face of the wrist-watch.

One example of this construction is shown in Hallman et al., U.S. Pat. No. 4,103,808. Hallman teaches a watchband that includes a pair of loops that enable the user to attach a watch face to the watchband using the pins of the watch face. The watchband further includes a protective flap which can be affixed over the watch face using Velcro® or the like.

Another example of this construction is shown in Chisolm, U.S. Pat. No. 6,199,730, which teaches a wristband having a first band sized for encircling a wearer's wrist, and a protective cover for securing over the watch to protect it from exposure or damage. The first band includes a ribbon that is adapted to engage the watch face and hold it on the wristband.

The disadvantage of this approach is that it is necessary to remove the watch face from its original watchband, and then re-attach the watch to the new protective watchband. Not only is this cumbersome, it is also undesirable to so mistreat the watch, especially if the watch is a particularly expensive watch.

Fletcher, U.S. Pat. No. 5,332,135, teaches another approach, in which an ordinary watch can be worn in conjunction with the protective apparatus. In this embodiment, the watch is worn on the user's wrist as usual, and the protective apparatus is worn over the watch. A portion of the protective apparatus is adapted to fit under the watch face, and a Velcro® strip fastens the portion to the remainder of the apparatus. The flexible material of the protective apparatus is used for shielding the attaching band of the instrument from the surrounding environment.

The prior art does not teach a wrist-watch protector that allows the user to wear a watch normally, using the watch's original watch band, and also includes the various advantages described below.

SUMMARY OF THE INVENTION

The present invention teaches certain benefits in construction and use which give rise to the objectives described below.

The present invention provides a watch protector for protecting a wrist-watch worn around a wrist. The wrist-watch has a watch face and a watchband. The watch protector includes a bottom protective panel, a top protective panel, and a watch cover portion. The bottom protective panel is adapted to be positioned around the wrist. The top protective panel is associated with the bottom protective panel to fit over the bottom protective panel such that the top and bottom protective panels together surround the watchband of the wrist-watch once the wrist-watch has been fastened around the bottom protective panel and the wrist. The watch cover portion is associated with the top protective panel to move between a watch protecting position wherein the watch cover portion protects the watch face, and a watch exposing position wherein the watch cover portion does not cover the watch face.

A primary objective of the present invention is to provide a watch protector having advantages not taught by the prior art.

Another objective is to provide a watch protector that can be used to protect a wrist-watch without removing the original watchband of the wrist-watch.

A further objective is to provide a strong, durable watch protector that protects the wrist-watch from contamination and damage.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a watch protector 10 for protecting a wrist-watch 12.

Figure 1:
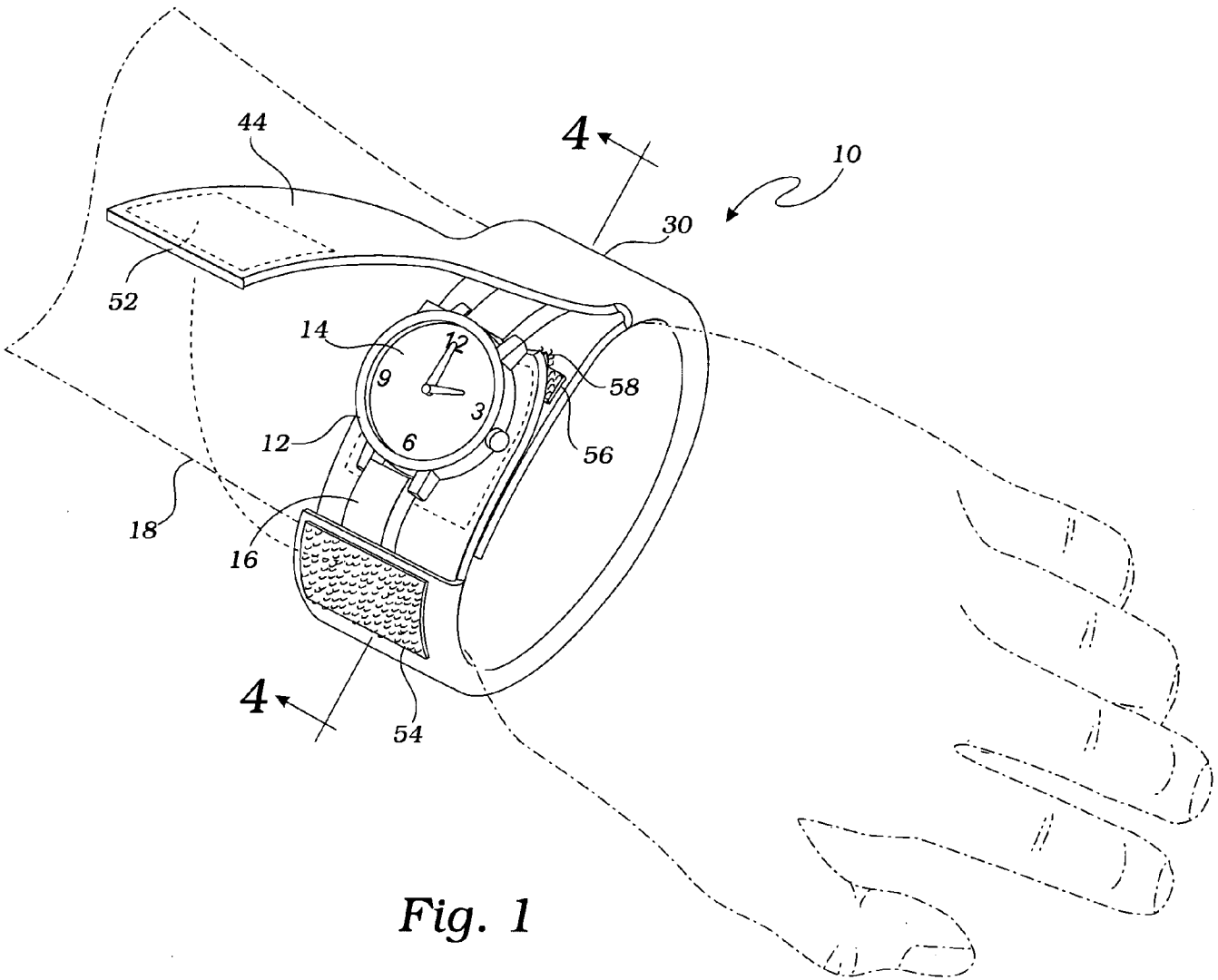
FIG. 1 is a perspective view of the preferred embodiment of the present invention, a watch protector for protecting a wrist-watch worn around a wrist.

As shown in FIG. 1, the watch protector 10 is adapted to be worn around a wrist 18 of a user. The watch protector 10 is adapted to fit around the wrist-watch 12 for protecting the wrist-watch 12 while the wrist-watch 12 is attached to the wrist 18 with a wristband 16. The watch protector 10 includes a watch cover portion 44 that can flex between a watch protecting position in which the watch cover portion 44 covers the watch face 14, and a watch exposing position in which the watch face 14 can be viewed for the purpose of determining the time.

Figure 2:
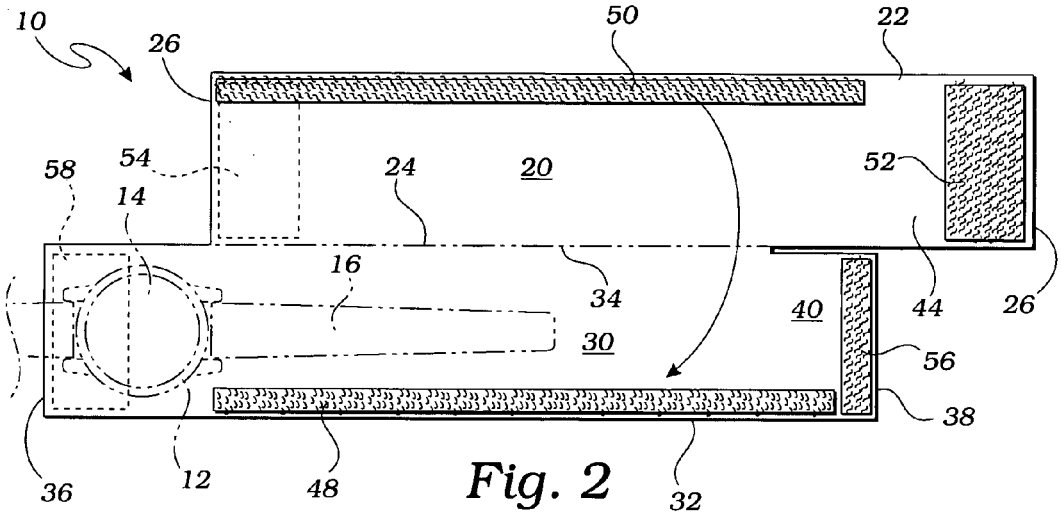
FIG. 2 is a top plan view of the watch protector is an open configuration, the view showing the wrist-watch in phantom to illustrate how the wrist-watch is positioned with respect to the watch protector.
Figure 3:
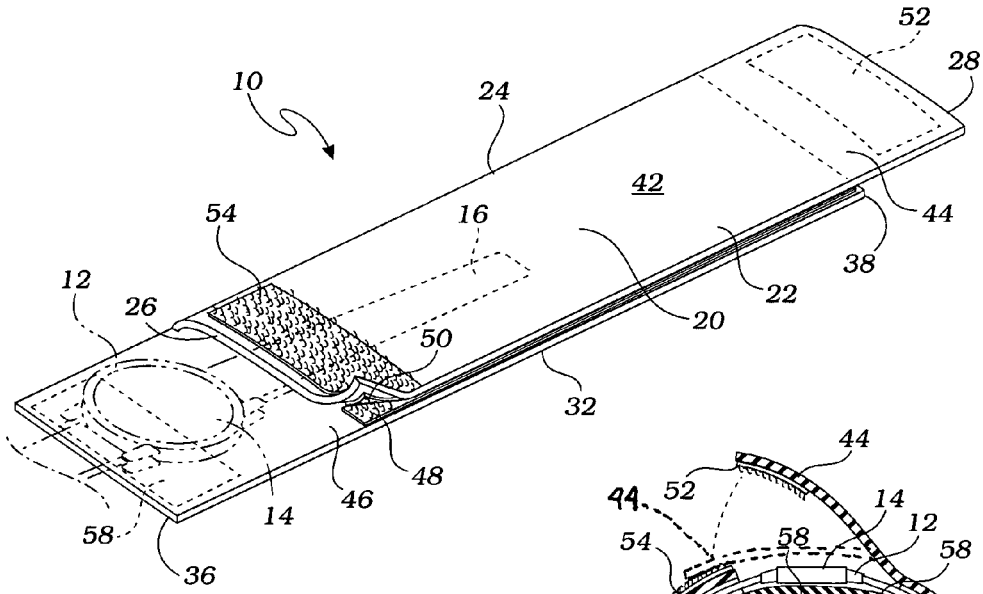
FIG. 3 is a perspective view of the watch protector in a folded configuration, illustrating how the wrist-watch, shown in phantom, is positioned inside and protected by the watch protector.

As shown in FIG. 2, the watch protector 10 includes a top protective panel 20 and a bottom protective panel 30 that are adapted to, together, surround, or "sandwich," the watchband 16 of the wrist-watch 12 therebetween. In one embodiment, the top protective panel 20 includes an outer longitudinal edge 22, and opposing, an inner longitudinal edge 24, which together terminate at a first end 26 and a second end 28, thereby defining generally rectangular region. The bottom protective panel 30 also includes an outer longitudinal edge 32, and opposing, an inner longitudinal edge 34, which together terminate at a first end 36 and a second end 38, thereby defining generally rectangular region. The top protective panel 20 and the bottom protective panel 30 may be constructed of a flexible material, such as either a natural or synthetic woven fabric or similar material. In alternative embodiments, the top and bottom protective panels 20 and 30 may be constructed of a sheet of plastic or similar material.

The watch protector preferably includes a means for removably joining the top protective panel 20 to the bottom protective panel 30 so that they remain in the folded configuration. In one embodiment, the inner longitudinal edge 24 of the top protective panel 20 is integral with the inner longitudinal edge 34 of the bottom protective panel 30, and they are both formed from a single sheet of flexible material having an inner surface 40 and an outer surface 42; however, in alternative embodiments, the inner longitudinal edges 24 and 34 could be separate and attached to each other by other means for joining, such as sewing, adhesives, hot glue, VELCRO®, buttons, or any other means of attachment that are well known in the art.

The means for removably joining preferably further includes a connector adapted to removably join the outer longitudinal edge 22 of the top protective panel 20 and the outer longitudinal edge 32 of the bottom protective panel 30. In one embodiment, the outer longitudinal edges 22 and 32 include a first longitudinal connector strip 48 and a second longitudinal connector strip 50, respectively, that together removably join the top protective panel 20 and the bottom protective panel 30. In the preferred embodiment, the first longitudinal connector strip 48 and the second longitudinal connector strip 50 are mating halves of hooks and loops connectors such as VELCRO®.

The watch cover portion 44 includes a means for removably fastening the watch cover portion 44 to the top protective panel 20. In one embodiment, the top protective panel 20 extends outwardly, beyond the second end 38 of the bottom protective panel 30, to form the watch cover portion 44, so that the watch cover portion 44 is an integral extension of the top protective panel 20. The bottom protective panel 30 preferably also includes a similar extended portion 46 at the first end 36, the extended portion 46 functioning to facilitate viewing of the watch face 14 when it is positioned within the watch protector 10. In this embodiment, the watch cover portion 44 also includes a first cover connector 52 that mates with a second cover connector 54 of the first end 26 of the top protective panel 20 to removably cover the watch face 14. The first cover connector 52 and the second cover connector 54 are preferably hooks and loops connectors such as VELCRO®. While the illustrated embodiment is currently preferred, alternative means for removably fastening may also be devised by those skilled in the art, including multiple VELCRO® connectors, sewings, zippers, or similar connectors or combinations thereof.

The watch protector 10 preferably further includes a means for removably attaching the first end 36 of the bottom protective panel 30 to the second end 38 thereof, for removably fastening the watch protector 10 around the wrist 18 of the user. The means for removably attaching preferably includes a first lateral connector 56 attached to the second end 38 of the bottom protective panel 30, and a second lateral connector 58 attached to the first end 36 of the bottom protective panel 30. The first and second lateral connectors 56 and 58 are preferably hooks and loops connectors such as VELCRO®. The second lateral connector 58 is preferably about 1.25 inches in length to provide for a range of size adjustments, while the first lateral connector 56 is preferably about 0.75 inches in length so that it can fit against the second lateral connector 58 without irritating the wrist 18 of the user.

It is important to realize that the invention should not be limited to the preferred embodiment shown, but should include similar or equivalent embodiments. For example, the placement of the Velcro® could be inverted, or placed in different but functionally equivalent positions. Such alternatives should be considered within the scope of the invention.

In use, the bottom protective panel 30 is wrapped around the wrist 18 of the user such that the outer surface 42 of the bottom protective panel 30 contacts the wrist 18 of the user. The wrist-watch 12 is fastened around the wrist 18 against the inner surface 40 of the bottom protective panel 30, such that the watch face 14 is positioned at least partially over the extended portion 46. The first and second lateral connectors 56 and 58 mate and serve to hold the watch protector 10 in position.

The top protective panel 20 is then folded over the wrist-watch 12 such that the first and second longitudinal connector strips 48 and 50 operate to connect the top and bottom protective panels 20 and 30 into a sleeve-like configuration. This enables the first cover connector 52 to removably engage the second cover connector 54, thereby completely covering and protecting the watch face 14.

Figure 4:
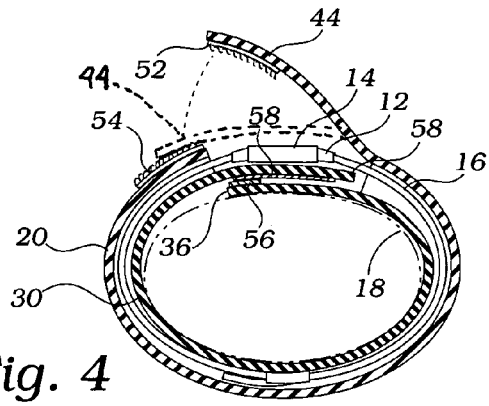
FIG. 4 is a side elevational sectional view of the wrist-watch and the watch protector once the watch protector has been positioned around an arm of a user, the view illustrating how the watch protecting portion moved from a watch exposing position, shown, to a watch protecting position, shown in phantom.

When the user wants to view the watch face 14, the user simply lifts the watch cover portion 44, as shown in FIG. 4, thereby disengaging the first and second cover connectors 52 and 54. As shown in FIG. 1, the user is then able to view the watch face 14.

It is important that at no time is the user required to disengage the watch face 14 from the wristband 16 in order to gain the protection of the watch protector 10. The wrist-watch 12 can be easily worn with the watch protector 10 without modification, and the wrist-watch 12 can also be removed from the watch protector 10 and worn alone at any time.

While the invention has been described with reference to at least one preferred embodiment, it is to be clearly understood by those skilled in the art that the invention is not limited thereto. Rather, the scope of the invention is to be interpreted only in conjunction with the appended claims.

All patents, patent applications, and other documents and printed matter cited or referred to in this application is hereby incorporated by reference in full.

What is claimed is:

1. A watch protector for protecting a wrist-watch worn around a wrist, the wrist-watch having a watch face and a watchband, the watch protector comprising:

a bottom protective panel adapted to be positioned around the wrist, the bottom protective panel having an inner longitudinal edge and an outer longitudinal edge which together terminate at a first end and a second end, thereby defining a generally rectangular region;

a top protective panel having an inner longitudinal edge and an outer longitudinal edge which together terminate at a first end and a second end, thereby defining a generally rectangular region, wherein the inner longitudinal edge of the top protective panel is attached to the inner longitudinal edge of the bottom protective panel such that the top protective panel can move with respect to the bottom protective panel between an open configuration wherein the top and bottom protective panels are positioned to receive the wrist-watch therebetween, and a folded configuration wherein the top and bottom protective panels are positioned to surround the watchband of the wrist-watch;

a means for removably joining the outer longitudinal edge of the bottom protective panel with the outer longitudinal edge of the top protective panel so that the top and bottom protective panels remain in the folded configuration;

a means for removably attaching the first end of the bottom protective panel to the second end of the bottom protective panel, for removably fastening the watch protector around the wrist; and a watch cover portion associated with the top protective panel to move between a watch protecting position wherein the watch cover portion protects the watch face, and a watch exposing position wherein the watch cover portion does not cover the watch face.

2. The watch protector of claim 1, further comprising a means for removably fastening the watch cover portion to the top protective panel so that it remains in the watch protecting position.

3. The watch protector of claim 2 wherein the means for removably fastening the watch cover portion includes a first cover connector of the watch cover portion that mates with a second cover connector of a first end of the top protective panel.

4. The watch protector of claim 3 wherein the first cover connector and the second cover connector are hooks and loops connectors.

* * * * *